United States Patent [19]

Moran

[11] 4,222,178

[45] Sep. 16, 1980

[54] METHOD AND APPARATUS FOR CONTROLLING A DRYING CYLINDER

[75] Inventor: Thomas L. Moran, Sylvania, Ohio

[73] Assignee: Midland-Ross Corporation, Cleveland, Ohio

[21] Appl. No.: 57,638

[22] Filed: Jul. 16, 1979

[51] Int. Cl.[3] ..... F26B 3/24

[52] U.S. Cl. ..... 34/41; 34/48; 34/119; 34/125; 165/90

[58] Field of Search ..... 34/41, 48, 51, 119, 34/124, 125; 165/90

[56] References Cited

U.S. PATENT DOCUMENTS

| | | | |
|---|---|---|---|
| 1,192,369 | 7/1916 | Barrms . | |
| 1,572,448 | 2/1926 | Simons . | |
| 1,643,972 | 10/1927 | Woodsome . | |
| 2,208,784 | 7/1940 | Armstrong | 34/48 |
| 2,811,787 | 11/1957 | Clements | 34/41 |
| 2,869,248 | 1/1959 | Justus | 34/125 |
| 3,156,540 | 11/1964 | Baert | 34/125 |
| 3,251,138 | 5/1966 | Whittaker | 34/48 |
| 4,089,121 | 5/1978 | Sawyer | 34/48 |
| 4,106,211 | 8/1978 | Holik | 34/48 |

*Primary Examiner*—Larry I. Schwartz
*Attorney, Agent, or Firm*—Richard A. Negin

[57] ABSTRACT

The present invention is a system for controlling the blow through steam in cylindrical dryers such as those used in the paper industry. The flow rate of the condensate is measured as is the flow rate of the steam blown through the drying cylinder. The ratio of the flow rate of the blow through steam to the flow rate of the condensate is thereby measured. Knowing the conditions of the paper going through the dryer, the desired conditions of the paper leaving the dryer and the feed steam pressure, the ideal amount of condensate can be determined and a given ratio set. The difference between the actual measured ratio and the set ratio is noted by a ratio control means and a compensation made by varying the pressure in the steam/water separator which is downstream from the drying cylinder. The amount of blow through steam for a given condensing load is thereby controlled and can be minimized.

19 Claims, 2 Drawing Figures

METHOD AND APPARATUS FOR CONTROLLING A DRYING CYLINDER

BACKGROUND OF THE INVENTION

This invention is in the field of drying cylinders; more particularly, the invention relates to an apparatus and method of operating drying cylinders for a papermaking machine.

Steam heated drying cylinders are used to dry formed webs of paper. Steam is fed into and condenses within the drying cylinders giving up its latent heat. The rotation of the drying cylinder forces the condensed steam against the inside of the cylindrical dryer wall. A means such as a syphon removes the condensate from the cylinder. In addition to condensate, steam also enters the syphon and leaves the drying cylinder. As discussed below, it is recognized in the art that it is desireable to control the amount of steam blow through. Until the present invention this has only been accomplished by the sizing of the apparatus involved with no continuous control.

A known method to control the amount of blow through steam is to place a carefully sized or designed orifice in the condensate discharge line. This permits the passage of a predetermined flow rate of condensate and the reduction of the level of steam blowing through to a desired minimum level. These orifices are desired for optimum dryer operation and cannot be continuously controlled. Such orifices are disclosed in U.S. Pat. Nos. 4,089,121 and 3,251,138.

Various systems, such as the one in U.S. Pat. No. 1,192,369, have been used to remove condensate from the drying cylinders. These systems comprise the creation of a pressure difference across the cylinder. In this way the desired condensate flow rate is obtained. However, no system continuously controls the amount of steam blown through with the condensate. In addition to merely creating a pressure difference, U.S. Pat. No. 2,811,787 attempts to achieve the optimum pressure difference to force out the condensate, which becomes a function of the velocity of the cylinder. Here no attempt is made to control the amount of blow through steam.

Presently, instantaneous measuring devices such as beta-ray scanners are used to continuously measure moisture in the paper and adjust the heat by controlling steam pressure accordingly. Other control schemes disclosed measure changes in steam pressure or condensate flow rate as an indication of the changing conditions of the paper or item being dried and signal the process to be adjusted accordingly. These latter control schemes are concerned with heat transferred to the paper and not with the control of the amount of blow through steam. Such systems are disclosed in U.S. Pat. Nos. 4,106,211; 2,208,784 and 3,251,138 which as noted above uses a carefully designed orifice to minimize instream blow through. Therefore, although many control schemes have been used none have been designed to control the amount of steam blow through.

Blow through steam can be recirculated as in U.S. Pat. Nos. 4,106,211 and 1,643,972 and reused at lower pressure in cascade drying cylinders as shown in U.S. Pat. No. 2,811,787.

The art indicates the importance of control in drying cylinders generally and for particularly minimizing the amount of blow through steam. The amount of blow through steam has been directly controled to minimum desired levels only by sizing equipment. It is desireable to continuously control the amount of blow through steam.

SUMMARY OF THE INVENTION

In its basic form the present invention is a system for controlling the blow through steam in cylindrical dryers such as those used in the paper industry. The flow rate of the condensate is measured as is the flow rate of the steam blown through the drying cylinder. The ratio of the flow rate of the blow through steam to the flow rate of the condensate is thereby measured. Knowing the conditions of the paper going through the dryer. The desired conditions of the paper leaving the dryer can be determined and a given ratio set. The difference between the actual measured ratio and the set ratio is noted by a ratio control means and a compensation made by varying the pressure in the steam/water separator which is downstream from the drying cylinder. The amount of blow through steam for a given condensing load is thereby controlled and can be minimized.

It is generally the object of the present invention to control the amount of steam blown through a drying cylinder.

It is an object of the present invention to controllably minimize the amount of steam blown through and thereby providing an energy savings.

It is an object of the present invention to compare the amount of blow through steam to the amount of steam condensing and use this ratio as one of the control parameters in the drying system. It is another object of the present invention to control the steam/water separator pressure to minimize the ratio during operation.

Finally, it is an object of the present invention to control the drying cylinder by measured parameters downstream of the cylinder, i.e. the ratio of the blow through steam to the condensate load and the upstream pressure. Downstream is the direction of flow away from the cylinder and upstream the direction from which flow comes to the cylinder.

It is an object of this invention to obtain one or more of the objects set forth above. These and other objects and advantages of this invention will become apparent to those skilled in the art from the following specification and claims, reference being had to the attached drawings.

DESCRIPTION OF THE PREFERRED EMBODIMENTS

Figure 1:
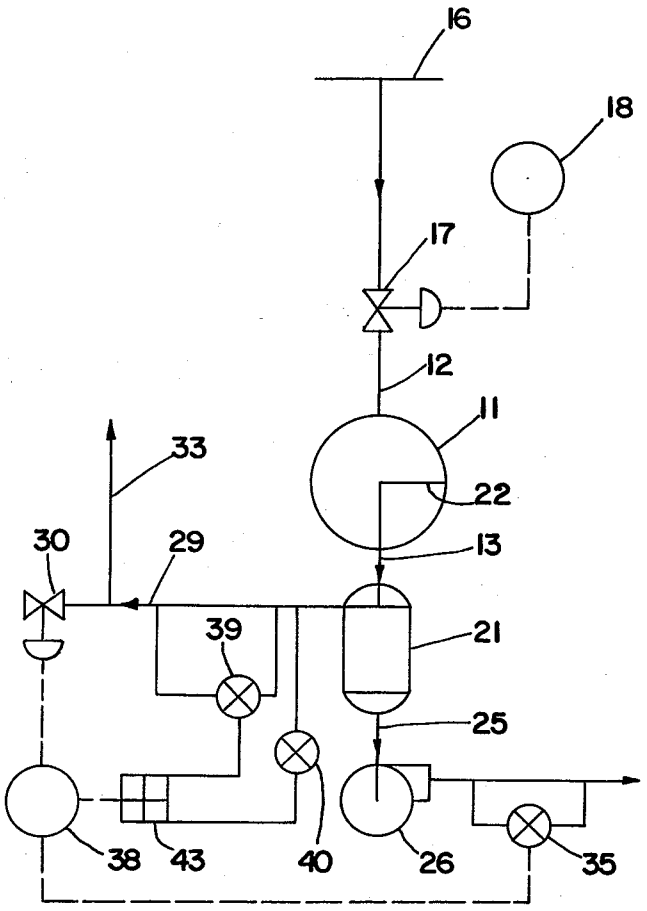
FIG. 1 shows a schematic diagram of a basic embodiment of the invention showing the dryer apparatus and attendant controls.

The basic concept of the present invention will be understood by those skilled in the art by having reference to FIG. 1 which is a schematic diagram illustrating a basic embodiment of the present invention. The drying system starts with the drying cylinder 11 having feed line 12 and discharge line 13. Steam is fed from steam feed line 16 through a means to control steam pressure such as a steam line control valve 17 to feed line 12 and into the drying cylinder 11. Discharge line 13 leads to a steam/water separator 21 which operates at a lower pressure than that in drying cylinder 11. Condensate from within the drying cylinder as well as a certain amount of steam passes through a fluid removal means, such as condensate syphon 22, through discharge line 13 and into steam/water separator 21. Condensate is removed from the steam/water separator 21 through condensate discharge line 25. A condensate pump 26 can be disposed within condensate discharge line 25 to pump condensate out of the steam/water separator 21 thereby monitoring a steady state level in separator 21. Blow through steam is removed through a blow through steam line 29 which leads from steam/water separator 21 to atmosphere relief valve 30. A blow through steam reuse line 33 can be connected to the blow through line 29 between the steam/water separator 21 and atmosphere relief valve 30. In this way, blow through steam can be recirculated to drying cylinder 11 or reused in a downstream drying cylinder system of dryers.

The system in its most basic form has steam fed to a drying cylinder where part of it condenses. Condensate as well as a certain amount of blow through steam passes to a steam/water separator. Condensate from the steam/water separator is separated and removed from the blow through steam which can be reused. The present invention is a system which controls the ratio of the blow through steam flow rate to the condensate flow rate to control the amount of blow through steam thereby enabling optimization of energy use in the drying cylinder or minimizing the amount of steam blown through while effectively meeting the drying requirements of the product, such as paper, being dried.

Generally, this control system operates by using a constant pressure steam input to the dryer although the steam pressure input to the dryer can vary as desired. Knowing the pressure of the steam entering the dryer and the conditions of the paper going to the dryer and the desired conditions of the paper leaving the dryer an ideal ratio of blow through steam to condensate flow rate can be set. The difference between the actual measured ratio and the set ratio is noted by a controller means and compensation made by varying the separator pressure. Preferably, the steam is controlled in direct proportion to the amount of condensate being formed.

This control scheme is accomplished by a condensate measuring mean 35 connected to condensate discharge line 25. A signal from condensate flow measuring means 35 is sent to a ratio control means such as a flow ratio controller 38. A means to measure blow through steam flow rate measures the blow through steam flow rate and signals the flow ratio controller. More particularly the flow rate of the blow through steam in blow through steam line is measured by blow through steam flow measuring means 39 and the pressure in the blow through steam line is measured by blow through steam line pressure measuring means 40. Blow through steam measuring means 39 and steam line pressure measuring means 40 are connected to blow through steam line 29 between steam/water separator 21 and blow through steam reuse line 33. The blow through steam flow rate signal is conditioned by sensing the blow through steam pressure in order to correct the sensed flow rate to an actual flow rate from the drying cylinder, i.e. at the pressure the blow through steam flow measuring means is operating. The pressure signal and the flow rate signal are inputed to an analogue characterizing device 43 or a micro processor which performs the correction. The corrections can be made electronically using theory concerning steam flow rate and steam pressures as are known in the art. A steam flow rate signal is sent from the analogue characterizing device to the flow ratio controller 38.

The flow ratio controller takes the adjusted blow through steam flow rate as a ratio of the condensate flow rate and compares it to a desired set point. The flow ratio controller then signals atmosphere relief valve 30 to open and close to adjust the downstream pressure, that is the pressure of the blow through steam line 29 and thereby the pressure back in the system to the steam/water separator so as to control the pressure difference across the drying cylinder 11 until the ideal blow through steam to condensate ratio is attained. The upstream steam pressure is controlled by a pressure indicating controller 18 which signals and controls steam line control valve 17.

Figure 2:
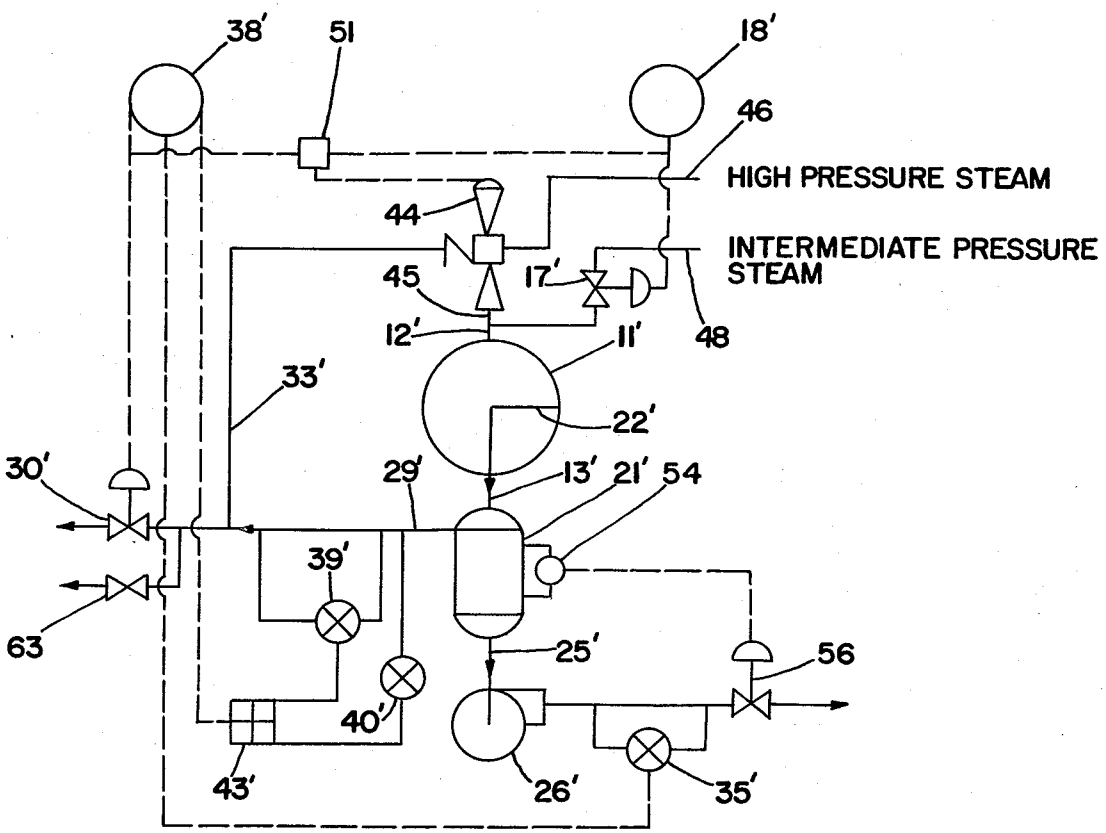
FIG. 2 shows a schematic diagram of the preferred embodiment of the present invention.

The basic method and apparatus of the present invention are shown in FIG. 1 and are described above. The blow through steam reuse line 33 can be directed to other drying cylinders in a cascade fashion as is known in the art; or can be recycled back to drying cylinder 11 as may be accomplished by use of vapor jet recompression devices such as a thermo compressor. FIG. 2 shows a preferred apparatus of the present invention used for recycling blow through steam. Corresponding parts between FIGS. 1 and 2 have the same reference characters, with corresponding characters in FIG. 2 primed.

The embodiment shown in FIG. 2 has corresponding elements to that in FIG. 1. These elements include the drying cylinder 11', feed line 12', condensate syphon 22', discharge line 13' and steam line control valve 17'. Discharge line 13' leads to steam/water separator 21'. There is a condensate discharge line 25', and there can be a condensate pump 26' disposed within condensate discharge line 25'. Blow through steam is discharged from steam/water separator 21' to atmosphere relief valve 30'. Corresponding measurement and control elements include condensate measuring means 35', steam flow measuring means 39', steam line pressure measuring means 40', flow ratio controller 38' and analogue characterizing device 43'. These elements in the embodiment of FIG. 2 have analogous operation to their counterparts in FIG. 1 as described above.

In a system as shown in FIG. 2, one large dryer such as the Yankee dryer is used and it is desireable to reuse the heat in the blow through steam. This can be accomplished through the use of a thermosyphon 44. The blow through steam reuse line 33' is connected to thermosphon 44. The steam in line 33' is at a lower pressure than the steam to be fed into the cylinder through feed line 12'. Therefore, the thermosyphon 44 is used to recompress the recirculating steam to a higher pressure. This is accomplished with the use of high pressure steam. Preferably, there are two steam lines leading to the system, a high pressure steam line 46 and an intermediate pressure steam line 48. The intermediate pressure steam line has within it a steam line control valve 17' which receives a signal from the pressure indicator controller 18'. This assures a desired constant or controlled pressure feed to feed line 12' and drying cylinder 11'. The high pressure steam line 46 is connected to the thermosyphon 44 and is used to recompress the recirculating steam to the desired pressure. The thermosyphon is operated so that steam coming from it to thermosyphon outlet line 45 is at a controlled pressure, preferably the same pressure as the steam coming from the intermediate pressure steam line 48 through steam line control valve 17'.

Thermosyphon demand relay 51 receives signals from the flow ratio controller 38' and the pressure indicator controller 18'. This relay acts as an authority selector, allowing the blow through ratio controller to dictate the position of the thermosyphon during normal operation, and the pressure controller to take over control of the thermosyphon during certain, unpredicatable upsets such as breaks in webbing. In dictating the position of the thermosyphon, the relay signals the admission of high pressure motivating steam to the thermosyphon through a variable orifice, thereby controlling the ratio of blow through steam recirculation.

There is a run/warm-up interlock 52 which is signalled to close the thermosyphon during warm up so that only the intermediate pressure steam is used. Run/-warm-up interlock is located between demand relay and thermosyphon 44.

When using the present invention either in a cascade system or in a recycle steam as shown in FIG. 2, it is desireable to have certain additional control features. One such feature is a level measuring device 54 to measure the level of condensate in a steam/water separator 21'. Disposed within condensate discharge line 25' it is a condesnate discharge line valve 56. Level measuring device 54 measures the condensate level in the steam/-water separator and signals the condensate discharge line valve 56. In this way the condensate level in the steam/water separator 21' is controlled and will never go below a set minimum and blow through steam discharge through the condensate discharge line 25'. The pump 26∝ can be shutdown until an adequate level in the stream/water separator 21' is relieved. High liquid level conditions in the separator 21' will be monitored as well. Level sensors as known in the art can be used. One such sensor can be a differential pressure sensor, which transmits a signal proportional to the separator liquid level. There can also be a manual atmospheric relief valve 63 as desired for manual control including use as a manual safety control.

In operation the basic system as shown in FIG. 1 is used to control the amount of blow through steam discharged from drying cylinder 11 at a constant pressure steam input. This is accomplished by measuring the flow rate of blow through steam and the flow rate of condensate and signalling the measured values to a flow ratio controller 38' which compares the ratio of the blow through steam flow rate to the condensate flow rate to assure a desired value of the ratio. The flow ratio controller controls an atmosphere relief valve 30' which communicates with the steam/water separator 21' so that by controlling the valve 30' the pressure in the steam/water separator can be controlled and thereby control the pressure difference across the drying cylinder and thereby amount of steam passing through the system. The blow through steam coming from the steam/water separator can be recycled as shown or used in a cascade drying system.

In a closed loop, the flow rate of incoming feed steam equals the condensing load. In an open loop, condensing load plus blow through steam passing to downstream units such as in a cascade equals the incoming flow rate.

More specifically, referring to FIG. 2, operation is analogous to the basic system discussed above and shown in FIG. 1. Blow through steam is recycled through blow through steam reuse line and back through a thermosyphon and into the drying cylinder.

This method of continually monitoring and setting the downsteam pressure based on the ratio of blow through steam to condensation solves the past problem of lack of control of blow through steam by using the controlled and preferably minimum amount of blow through steam needed. In the present invention, control is almost instantaneous based on condensation formation. The incoming steam pressure is not tied to the flow rate controller.

It would be obvious for the ratio control means to be a computer instead of the flow ratio controller 38'. Instead of feeding the signals from condensate flow measuring means 35,35', blow through steam flow measuring means 39,39' and blow through steam line pressure measuring means 40 and 40' into analogue characterizing device 43,43' and flow rate controller 38, 38', the signals can be fed to the computer which can be used to control the system by sending a signal to control the atmosphere relief valve. In addition to performing the function of the flow ratio controller, the computer software program can be used to trim the blow through steam to condensing load ratio until a minimum is reached. More specifically, an initial ratio value is preset at which the process is to begin. Signals from the above referenced measuring devices are continually monitored by the computer. The computer is programed to continually decrease the ratio of the blow through steam to the condensing load. Once the computer is signalled that the condensing load has dropped below an ideal steady state value, it increases the ratio. It then begins to decrease the ratio at a predetermined rate to the point before it went below the minimum acceptable steady state value. Steady state is maintained until a condensing load dependent variable changes. This particular computer program has its goal minimization of blow through steam and not optimization. Of course the trimming function can be accomplished by manually trimming but using the computer provides the advantage of instantaneous response and continuous monitoring.

Using equipment such as beta-gauge scanners, a forward feed system can be used to project events that will happen before they can be measured by the control system of the present invention. The effects of the projected changes can be fed into a computer which can be used to anticipate and compensate for the changes before they are measured. This can be combined with the actual control of the present invention to compensate for the predicted continuities. The system can be set up so that only discontinuities of certain magnitudes or certain types can be compensated for and others ignored.

Modifications, changes, and improvements to the preferred form of the invention herein disclosed, described and illustrated may occur to those skilled in the art who come to understand the principals and precepts thereof. Accordingly, the scope of the patent to be issued herein should not be limited to the particular embodiments of the invention set forth herein, but rather should be limited by the advance of which the invention has promoted the art.

What is claimed is:

1. An apparatus for controlling steam blow through flow rate for a drying cylinder, having a feed line to the cylinder, a means to remove fluids from within the cylinder, a discharge line from the drying cylinder connected to the fluid removal means, wherein the apparatus comprises:

a means to control steam pressure in the feed line;
a steam/water separator connected to the discharge line;
a condensate discharge line from the steam water separator;
a means to measure condensate flow rate connected to the condensate discharge line and for emitting a signal in response to the measured flow rate;
a blow through steam line from the steam/water separator;
a means to measure blow through steam flow rate connected to the blow through steam line and for emitting a signal in response to the measured flow rate;
an atmosphere relief valve connected to the blow through stream line;
a ratio control means which receives signals from the means to measure blow through steam flow rate and from the means to measure flow rate and sends a signal to control the atmosphere relief valve based on the ratio of the signals received by the flow ratio controller.

2. the controller apparatus of claim 1 further comprising a pump disposed within the condensate discharge line.

3. The controller apparatus of claim 1 wherein the ratio control means is a flow ratio controller.

4. The controller apparatus of claim 3 wherein the means to measure blow through steam further comprises:
a means to measure the blow through steam flow rate in the blow through steam line and for emitting a signal in response to the measured flow rate;
a means to measure the blow through steam line pressure and for emitting a signal in response to the measured steam pressure;
a means to receive the measured pressure and flow rate signals and adjust them so as to emit a signal which reflects the flow rate of blow through steam from the steam/water separator and to send this adjusted signal to the flow ratio controller.

5. The controller apparatus of claim 3 further comprising a blow through steam reuse line connected to the blow through line between the blow through steam measuring means and the atmosphere relief valve.

6. The controller apparatus of claim 5 wherein the blow through steam is recycled through reuse line to the drying cylinder.

7. The controller apparatus of claim 5 wherein the blow through steam is reused in a cascade drying system.

8. An apparatus for controlling steam blow through flow rate for a drying cylinder, having a feed line to the cylinder, a means to remove fluid from within the cylinder, a discharge line from the drying cylinder connected to the fluid removal means, wherein the apparatus comprises:
an intermediate steam line connected to the feed line;
a means to control steam pressure in the intermediate steam line;
a steam/water separator connected to the discharge line;
a condensate discharge line from the steam/water separator;
a means to measure condensate flow rate connected to the condensate discharge line and for emitting a signal in response to the measured flow rate;
a blow through steam line from the steam/water separator;
a means to measure blow through steam flow rate connected to the blow through steam line and for emitting a signal in response to the measured flow rate;
an atmosphere relief valve connected to the blow through steam line;
a flow rate controller which receives signals from the means to measure blow through steam flow rate from the means to measure condensate flow rate and sends a signal to control the atmosphere relief valve based on the ratio of the signals received by the flow ratio controller;
a reuse line connected to the blow through line between the blow through steam measuring means and the atmosphere relief valve;
a thermosyphon connected to the reuse line;
a high pressure steam line connected to the thermosyphon;
a syphon outlet line connecting the syphon to the feed line;
a thermosyphon demand relay which receives signals from the flow ratio controller and the means to control intermediate steam pressure and controls the thermosyphon to receive as much high pressure steam as is needed thereby controlling the rate of blow through steam recirculation.

9. The controller apparatus of claim 8 further comprising a pump disposed within the condensate discharge line.

10. The controller apparatus of claim 8 wherein the means to measure blow through steam further comprises:
a means to measure the blow through steam flow rate in the blow through steam line and for emitting a signal in response to the measured flow rate;
a means to measure the blow through steam line pressure and for emitting a signal in response to the measured steam pressure;
a means to receive the measured pressure and flow rate signals and adjust them so as to emit a signal which reflects the flow rate of blow through steam from the steam/water separator and to send this adjusted signal to the flow ratio controller.

11. A method of controlling the amount of steam blowing through a drying cylinder, there being a feed line to the drying cylinder a means to remove fluids from the drying cylinder, a discharge line from the drying cylinder connected to the fluid removal means, a steam/water separator connected to the discharge line, a condensate discharge line from the steam/water separator, a blow through steam line from the steam/water separator and an atmosphere relief valve connected to the blow through steam line, comprising the steps of:
feeding steam through the feed line into the drying cylinder;
controlling the pressure of steam being fed to the feed line with a means to control steam pressure;
removing condensate and blow through steam from the drying cylinder through the fluid removal means and into the steam/water separator;
removing the condensate from the steam/water separator through the condensate discharge line;
measuring the flow rate of the condensate being removed;
signalling the condensate flow rate to a ratio control means;

removing the blow through steam from the steam water separator through the blow through steam line;

measuring the flow rate of the blow through steam being removed;

signalling the blow through steam flow rate to the ratio control means;

controlling the atmosphere relief valve with the ratio control means in response to a ratio of signals received by the ratio control means whereby the steam/water separator pressure is controlled and thereby the amount of blow through steam blowing through the drying cylinder.

12. The method of claim 11 wherein the ratio control means is a flow ratio controller.

13. The method of claim 12 wherein the step of measuring the flow rate of the blow through steam further comprises:

measuring the blow through steam pressure in the blow through steam line;

measuring the blow through steam flow rate in the blow through steam;

signalling the blow through steam flow rate and pressure in the blow through steam line to a means to receive the pressure and flow rate signals and adjust them so as to send a signal to the flow ratio controller which reflects the flow rate of the blow through steam from the steam/water separator.

14. The method of claim 12 further comprising the step of:

feeding the blow through steam to a blow through reuse line to be used in upstream drying cylinders in a cascade system.

15. The method of claim 11 or 14 further comprising the stepsof:

measuring the condensate level in the steam/water separator with a level measuring device;

controlling condensate discharge line valve in response to a signal from the level measuring device to prevent the condensate level in the steam/water separator from going above or below set levels.

16. The method of claim 12 wherein the blow through steam is controlled in direct proportion to the condensate being formed.

17. The method of claim 12 further comprising the steps of:

feeding the blow through steam to a blow through reuse line to a thermosyphon; p1 feeding high pressure steam to the thermosyphon;

controlling the pressure of the high pressure steam;

controlling the thermosyphon with a thermosyphon demand relay which receives signals from the flow ratio controller and the means to control intermediate steam pressure so as to receive only as much high pressure steam as is needed to control the rate of blow through steam recirculation;

feeding the steam from the thermosyphon to the feed line.

18. The method of claim 11 further comprising the steps of:

taking the ratio of the blow through steam flow rate signal and the condensate flow rate signal using the ration control means;

trimming the ratio signal, which is used to control the atmosphere relief valve.

19. The method of claim 18 wherein trimming further comprises the steps of:

presetting an initial ratio at which the process is to begin continually monitoring the ratio;

continually decreasing the ratio;

signalling the computer that the ratio is below an ideal steady state value;

increasing the ratio signal sent to the atmosphere relief valve to some value greater than the ideal steady state value;

continually decreasing the ratio at a predetermined rate to the point before the ratio was lower than the minimum acceptable steady state value.

* * * * *